US005493111A

United States Patent [19]

Wheeler et al.

[11] Patent Number: 5,493,111

[45] Date of Patent: Feb. 20, 1996

[54] PHOTOMULTIPLIER HAVING CASCADED MICROCHANNEL PLATES, AND METHOD FOR FABRICATION

[75] Inventors: Kevin D. Wheeler, Mesa; Michael J. Iosue, Tempe; Bruce Johnson, Phoenix, all of Ariz.

[73] Assignee: Litton Systems, Inc., Woodland Hills, Calif.

[21] Appl. No.: 100,055

[22] Filed: Jul. 30, 1993

[51] Int. Cl.[6] ..... H01J 40/14

[52] U.S. Cl. ..... 250/207; 313/105 CM

[58] Field of Search ..... 250/207, 214 VT, 250/214 LA; 313/105 R, 535, 532, 105 CM, 103 CM, 533

[56] References Cited

U.S. PATENT DOCUMENTS

| | | | |
|---|---|---|---|
| 3,745,554 | 7/1973 | Grant | 313/105 CM |
| 4,024,390 | 5/1977 | Bosserman et al. | 250/207 |
| 4,568,853 | 2/1986 | Boutot | 313/103 CM |
| 4,794,296 | 12/1988 | Warde et al. | 313/105 R |
| 4,948,965 | 8/1990 | Feller | 250/207 |

*Primary Examiner*—Edward P. Westin
*Assistant Examiner*—Que T. Le
*Attorney, Agent, or Firm*—Poms, Smith, Lande & Rose

[57] ABSTRACT

A photomultiplier includes a cascade of microchannel plates which are physically and electrically connected to provide an electron multiplication through the microchannel cascade. One of the microchannel plates is a high-output microchannel plate providing a high level of electron multiplication. This high output microchannel plate is thermally conducted to ambient by a heat transfer path including outwardly disposed microchannel plates in the cascade. A unitary ceramic housing defines a vacuum envelope for the photomultiplier.

24 Claims, 3 Drawing Sheets

FIG. 4.
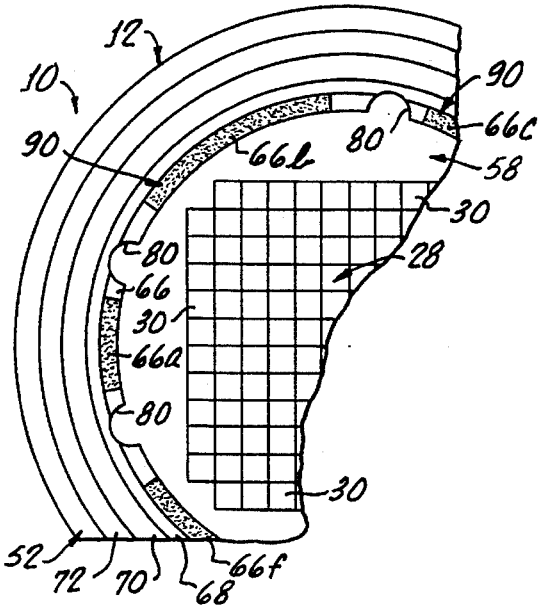
FIG. 5.
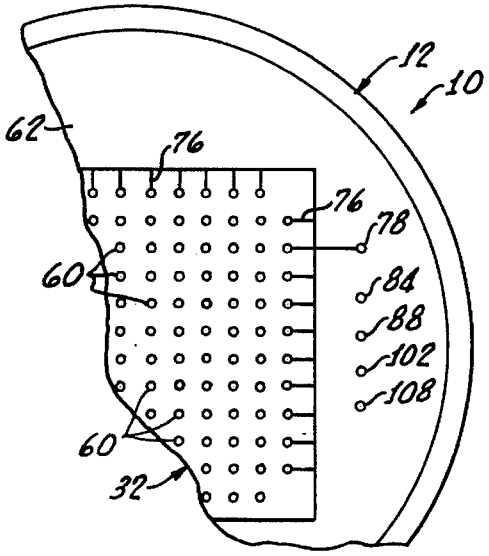
FIG. 6.
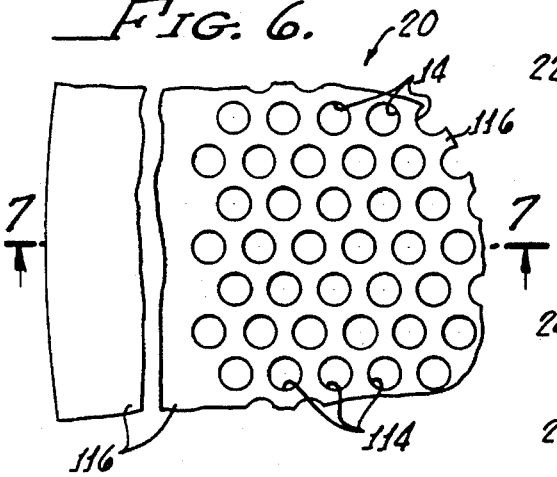
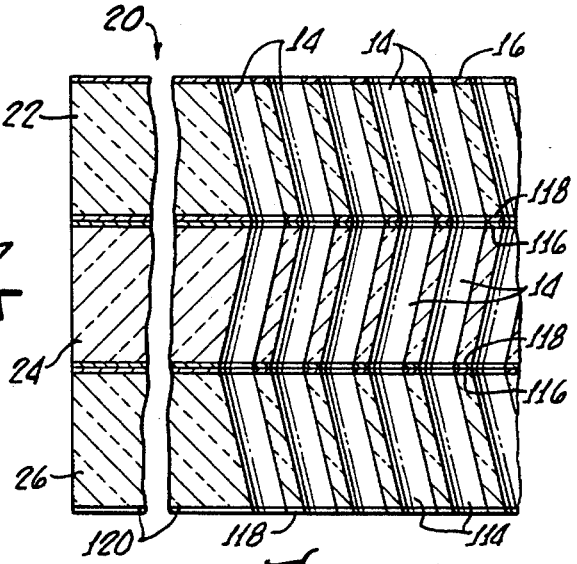
FIG. 7.
FIG. 8.
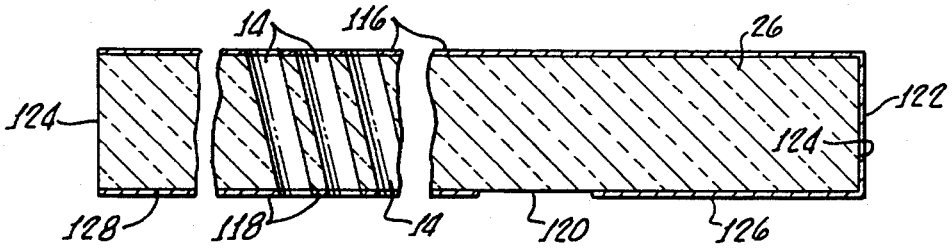

PHOTOMULTIPLIER HAVING CASCADED MICROCHANNEL PLATES, AND METHOD FOR FABRICATION

BACKGROUND OF THE INVENTION

1. Field of the Invention

The present invention relates to a high-output photomultiplier having a microchannel plate. More particularly, the present invention relates to such a high-output photomultiplier tube having a plurality of sequentially arranged and cascaded electron multiplier microchannel plates. Still more particularly, the present invention relates to such a high output photomultiplier having a unitary multi-layer ceramic body assembly.

2. Related Technology

Microchannel plates have been used in various devices to intensify low-level images. For example, in night vision devices, a photoelectrically responsive photocathode element is used to receive photons from a low-level image. The photocathode produces a pattern of electrons (hereinafter referred to as, "photoelectrons") which corresponds with the pattern of photons from the low-level image. This pattern of electrons is introduced into a microchannel plate, which by secondary emission of electrons in a plurality of small (or micro) channels produces a shower of electrons in a pattern corresponding to the low-level image. That is, the microchannel plate emits the photoelectrons along with proportional secondary emission electrons to form an electron shower. This shower of electrons at an intensity much above that produced by the photocathode is directed onto a phosphorescent screen. The phosphors of the screen produce an image in visible light which replicates the low-level scene. Understandably, because of the microchannel plate, the representative image is pixalized, or is a mosaic of the low-level image.

More particularly, the microchannel plate itself conventionally includes a bundle of very small cylindrical tubes which have been fused together into a parallel orientation. These small cylindrical tubes have their length arranged along the thickness of the microchannel plate. That is, the thickness of the bundle is not very great in comparison to its size or lateral extent. Thus, a microchannel plate has the appearance of a thin plate with parallel opposite surfaces. Each tube forms a passageway or channel opening at its opposite ends on the opposite faces of the plate. Also, each tube is slightly angulated with respect to a perpendicular from the parallel opposite faces of the plate so that electrons approaching the plate perpendicularly can not simply pass through the many channels without interacting with the plate.

Internally the many channels of the microchannel plate are each coated with a material having a high propensity to emit secondary electrons when an electron falls on the surface of the material. Also, the opposite faces of the microchannel plate are provided with a conductive electrode coating so that a high voltage can be applied across the plate. A voltage is also applied between the photocathode and the microchannel plate to move the photoelectrons emitted by the photocathode to the microchannel plate. Consequently, electrons produced by the photocathode in response to photons from an image travel to the microchannel plate in an electron pattern corresponding to the low-level light image. These electrons enter the channels of the microchannel plate and strike the angulated walls which are coated with the secondary electron emissive material. Thus, the photoelectrons from the photocathode, plus the secondary emission electrons in numbers proportional to the number of photoelectrons, exit the channels of the microchannel plate to impinge on a phosphorescent screen. Because the microchannel plate is supplying a considerable number of electrons which become part of the electron shower on the phosphorescent screen, the plate is designed to support an electrical current between its opposite face electrodes. This electrical current between the opposite faces of a microchannel plate is known as a "strip current" and a portion of which replaces the secondary emission electrons supplied by the microchannel plate. Thus, the magnitude of strip current controls the magnitude of the maximum electron shower on the phosphor screen. This strip current is also the source of the electrical resistance heating experienced by a microchannel plate.

Alternatively, rather than directing the electron shower from a microchannel plate to a phosphorescent screen to produce a visible image, this shower of electrons may be directed upon an anode in order to produce an electrical signal indicative of the light or other radiation flux incident on the photocathode. As will be further explained, a device making such use of a microchannel plate is generally referred to as a photomultiplier tube, although internally of the device, electrons are cascaded or multiplied rather than photons.

Still alternatively, such a microchannel plate can be used as a "gain block" in a device having a flow of electrons. That is, the microchannel plate provides a spatial output pattern of electrons replicating an input pattern and at a higher electron density. Such a device is useful, for example, to detect high energy particle interactions which produce electrons. Alternatively, such a device is useful as a particle counter when provided with an input element which sheds an electron when a particle of interest collides with the input element. The shed electron then stimulates the emission of secondary electrons, and an output current signal proportional to the number of particles is produced.

Conventional photomultiplier tubes are also known which make use of cascaded microchannel plates. That is, multiple microchannel plates are arranged in series so that the initial electrons from a photocathode, for example, fall into the first microchannel plate. From this first plate, the initial electrons and the secondary electrons from the first plate fall into a second microchannel plate. This second microchannel plate adds its own secondary emission electrons, and provides an increasingly intense shower of electrons. This shower of electrons may flow to a third or subsequent microchannel plate for further multiplication. In this way a very high electron gain or amplification may be effected, with each initial electron falling into the first plate resulting in several hundred to several millions of electrons flowing from the last microchannel plate of the cascade and to an anode. At the anode, the electron charge pulses are processed to count initial electrons, or to generate an image electronically, for example.

With the conventional photomultiplier tubes using cascaded microchannel plates, the electrostatic voltage is connected across the top electrode of the top microchannel plate and the bottom electrode of the last or bottom microchannel plate in the cascade. The microchannel plates of such a conventional photomultiplier tube are electrically connected in series. Thus, each of the microchannel plates in the cascade experiences the same strip current. The conventional photomultiplier tubes generally use resistance matched microchannel plates in order to control the voltage drop across each of the microchannel plates within the cascade. In other words, the last microchannel plate in such a cascade must have similar strip current as the earlier plates in order to provide the same level of electron multiplication. Conventional microchannel plate photomultiplier tubes are in part limited by the maximum output which can be sustained by the strip current of the last microchannel plate. The conventional approach would use cascaded high strip current microchannel plates to achieve high output, however, cascaded high strip current microchannel plates lead to excessive heating and thermal destruction of the cacaded plates and photomultiplier tube. In order to prevent such a thermal destruction of conventional photomultipliers, the cascaded microchannel plates are selected so that the cascade carries only a strip current which it can thermally sustain. However, this expedient understandably limits the performance of the conventional photomultiplier tubes in terms of their electron multiplication level.

A conventional microchannel plate is known in accord with U.S. Pat. No. 4,737,013, issued 12 Apr. 1988, to Richard E. Wilcox. This particular microchannel plate has an improved ratio of total end open area of the microchannels to the area of the plate. As a result, the photoelectrons are not as likely to miss one of the microchannels and impact on the surface of the microchannel plate to be bounced into another one of the microchannels. Such bounced photoelectrons, which then produce a number of secondary electrons from a part of the microchannel plate not aligned with the proper location of the photoelectron, provide noise or visual distortion in the image produced by the image intensifier. The image intensifier taught by the Wilcox patent solves this problem of the conventional technology.

Other specific uses of microchannel plates are in the image intensifier tubes as found in the night vision devices commonly used by police departments and by the military for night time surveillance, and for weapon aiming. However, as mentioned above, microchannel plates may also be used to produce an electric signal indicative of the light flux or intensity falling on a photocathode. In other words, if a single anode is disposed at the location ordinarily occupied by the phosphorescent screen, this anode will provide a current indicative of the photons received from a low-level scene. If the single anode is replaced with a grid or array of anodes, the various anodes will provide individual signals which are an electrical analogue of the image mosaic. Consequently, these electrical signals could be used to drive a video display, for example, or be fed to a computer for processing of the information present in the electrical analogue of the image.

In view of the above, it is easily understood that an image intensifier could be used as a detector for electronically detecting the occurrence of events which produce photons, such as collisions in a test chamber of a particle accelerator. When such an image intensifier is provided with an array of anodes, the occurrence of a signal at one of the anodes indicates the occurrence of an event, and the location and intensity of the signal can provide information about the event. An array of such detectors may be used to provide multiple indications of such events, and to provide comprehensive information about the events occurring in a large test chamber.

SUMMARY OF THE INVENTION

In view of the deficiencies of the prior art, it is a primary object for this invention to provide a cascaded microchannel plate assembly in which the microchannel plates are in electrically contacting engagement with one another.

An additional object for this invention is to provide such a microchannel plate assembly in which at least one of the microchannel plates in the cascade is individually connected to receive a controlled level of bias voltage.

Yet another object for the present invention is to provide a cascaded microchannel plate assembly in which the last microchannel plate in the cascade is individually provided with connection to a controlled bias voltage so that the strip current of this last microchannel plate can be selectively controlled.

Further, an object of the present invention is to provide such a cascaded microchannel plate assembly in which at least one of the microchannel plates is a high output microchannel plate having a strip current and level of electron multiplication significantly above the strip currents experienced by the analogously positioned microchannel plates of conventional photomultiplier tubes.

Still further, an object of the present invention is to provide such a cascaded microchannel plate assembly in which the high-output microchannel plate is the last plate in the cascaded plate array.

Still another object for the present invention is to provide a photomultiplier tube having such a cascaded microchannel plate assembly.

An additional object for the present invention is to provide such a photomultiplier tube which includes a unitary multi-layer ceramic housing which defines the vacuum envelope for the cascaded microchannel plate assembly.

Another object is to achieve cooling of the final high strip current microchannel plate in a stacked assembly of microchannel plates, in which thermal cooling of the high strip current microchannel plate is achieved by the heat flow through the low strip current microchannel plates that are in contact with the high strip current microchannel plate and the cooler vacuum tube body.

These and additional objects and advantages of the present invention will be apparent from a reading of the following detailed description of a single preferred exemplary embodiment of the invention, taken in conjunction with the following drawing Figures, in which the same reference numbers refer to the same feature, or to features which are analogous in structure or function.

DESCRIPTION OF THE DRAWING FIGURES

FIG. 1 provides a schematic representation of a photomultiplier tube embodying the invention;

FIG. 4 is a fragmentary plan view of a base portion of the photomultiplier tube seen in the other drawing Figures;

FIG. 5 provides a fragmentary underside view of the photomultiplier tube;

FIG. 6 provides an enlarged fragmentary plan view of a portion of a microchannel plate of the photomultiplier tube seen in the earlier drawing Figures;

FIG. 7 is a cross sectional elevation view taken at line 7—7 of FIG. 6; and FIG. 8 provides a fragmentary side elevation sectional view of a peripheral edge portion of a high-output microchannel plate of the photomultiplier tube seen in the other drawing Figures.

DESCRIPTION OF THE PREFERRED EXEMPLARY EMBODIMENT OF THE INVENTION

Figure 1:
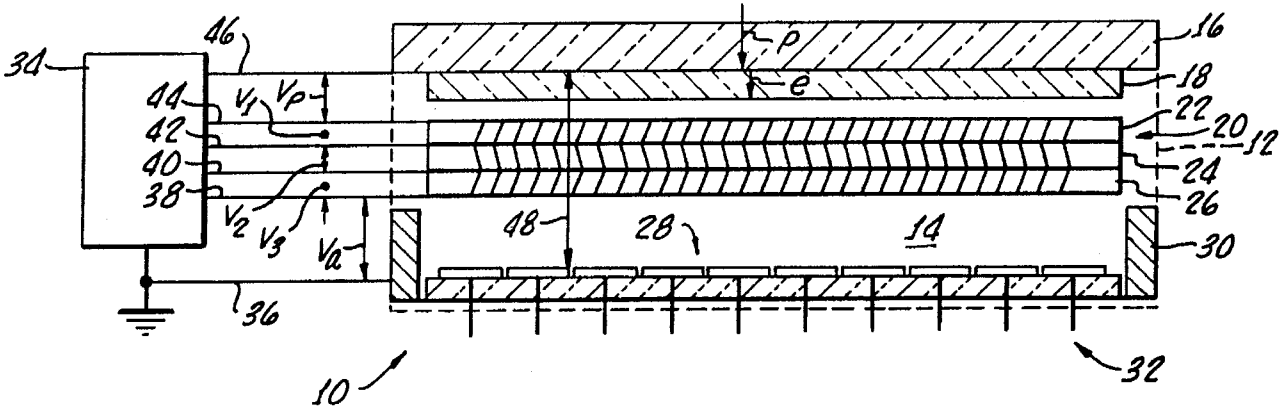

Viewing FIG. 1, a photomultiplier tube 10 embodying the present invention is schematically represented. The photomultiplier 10 includes a housing, schematically depicted with dashed line 12, within which an evacuated chamber 14 is defined. At one end, the housing includes a transparent window portion 16, which sealingly joins with the remainder of the housing while allowing radiation, possibly in the form of photons represented with the arrow "P", to strike the photocathode 18, made of semiconductor type material which, with some probability, emits an electron (indicated with arrow "e") for each photon striking the photocathode. As will be seen, a prevailing electrostatic field causes the emitted electrons from the photocathode 18 to proceed downwardly, viewing FIG. 1.

Below the photocathode 18, the photomultiplier tube 10 includes a Z-channel, stacked and cascaded microchannel plate assembly, generally referenced with the numeral 20. The microchannel plate assembly 20 includes multiple stacked, physically connected, and electrically interconnected microchannel plates, 22, 24, and 26. Each one of these microchannel plates, by secondary emission of electrons, adds proportional numbers of electrons to an electron shower cascading downwardly through the assembly 20 beginning with each electron "e" which falls into the first plate 22. Understandably, this electron shower replicates the pattern of photons "P" striking the photocathode 18, but is of much greater intensity.

Below the microchannel plate assembly 20, the photomultiplier tube 10 includes an array of anodes 28, which are shielded within a grounded ring structure 30. However, a single anode may be disposed at the location of the array of anodes 28. The electron shower from the lowermost microchannel plate 26 falls on the anodes 28, and is converted to an electric current appearing on a corresponding array of connector pins 32 outwardly disposed on the housing 12.

In order to make the photomultiplier tube 10 function, an electrostatic power supply, referenced with the numeral 34 is connected to a ground lead 36 connecting to the shield ring 30. This power supply 34 is also connected via respective connectors 38–46 to the photomultiplier tube 10. These connectors have progressively lower voltages with respect to ground so that an electrostatic field, generally referenced with the arrow 48 prevails in the photomultiplier tube 10 during operation. The arrow 48 is conventionally directed from positive potential to negative potential. However, electron movement is in the opposite direction to arrow 48. In order to further clarify the applied voltages on the component parts of the photomultiplier 10, the voltages between the ground potential lead 36 and the leads 38–46 in succession are annotated on FIG. 1. That is, the electrode at the lower side of the stacked microchannel plates 20 (that is, the lower side of the lower plate 26) is at a negative potential Va with respect to ground potential. The electrode at the upper side of this lower plate 26, as well as the electrode at the lower side of the middle plate 24, is at a potential V3 additionally negative with respect to the lead 38.

Next higher in negative potential (at a voltage differential V2) are the electrodes at the upper side of the middle plate 24, and at the under side of the upper plate 22. Finally, for the assembly 20, the electrode at the upper side of the upper plate 22 is at the highest potential (V1 higher than the lower side of plate 22), as is provided by the lead 44. The lead 46 applies a yet higher negative potential Vp to the photocathode 18. Consequently, there is a strong incentive for electrons that are emitted from the photocathode 18 to travel to the anodes 28. Also, there is a strong incentive for secondary emission electrons to be emitted from the microchannel plates 22–26, and to also travel to the anodes 28.

Figure 2:
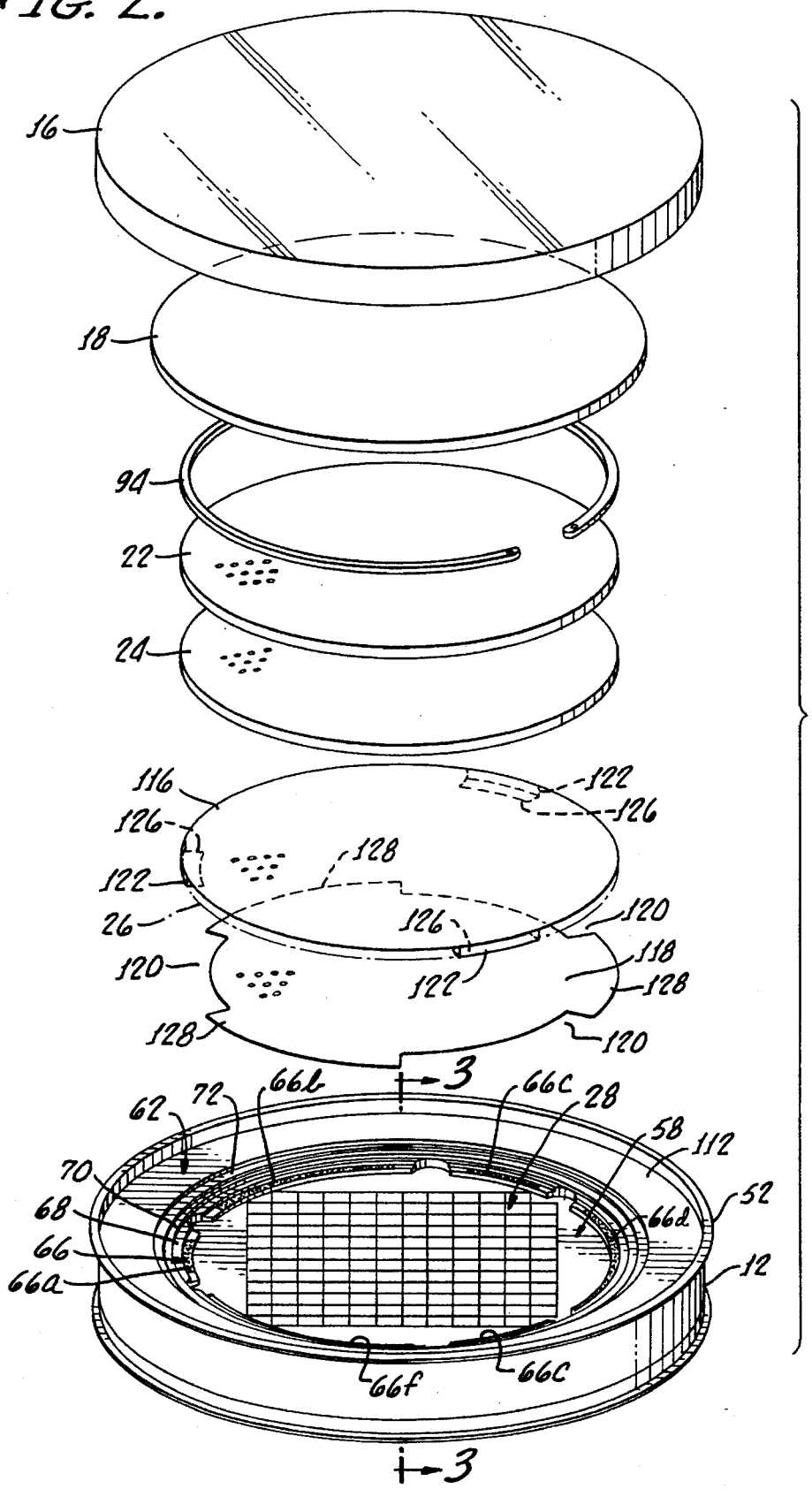
FIG. 2 is an enlarged exploded perspective view of a photomultiplier tube embodying the present invention.

Viewing now FIGS. 2–8 in conjunction, it is seen that an exemplary photomultiplier tube 10 includes a housing 12 defined cooperatively by a multilayer unitary ceramic base member 50, which sealingly cooperates with a disk shaped window member 16 to define an evacuated chamber 14. In FIG. 2, the thickness of various component parts of the photomultiplier tube 10 is shown exaggerated to better illustrate salient structural features of the invention. Those ordinarily skilled in the pertinent arts will recognize that the component parts of the photomultiplier are in fact very thin physical structures. That is, a microchannel plate may typically have a thickness of about 0.015 to 0.020 inches (0.5 to 0.6 mm). Also, in FIG. 7, the size of microchannels in the plates 22–26 is shown much exaggerated in comparison to the thickness of these plated to ease the burden of illustrating the invention. However, those ordinarily skilled in the pertinent arts will recognize that even at a thickness of from 0.015 to 0.020 inches, the microchannel plates 22–26 are many times thicker than the diameter of the microchannels. Typically, the microchannels will be on the order of about ten microns in diameter. At the sealing interface of the base member 50 and the window member 16, a braze flange member 52 interposes between these two components to effect their sealing engagement, and to act both as an electrical connector member for the photocathode 18 and as a heat transfer member, as will be described in greater detail below.

Figure 3:
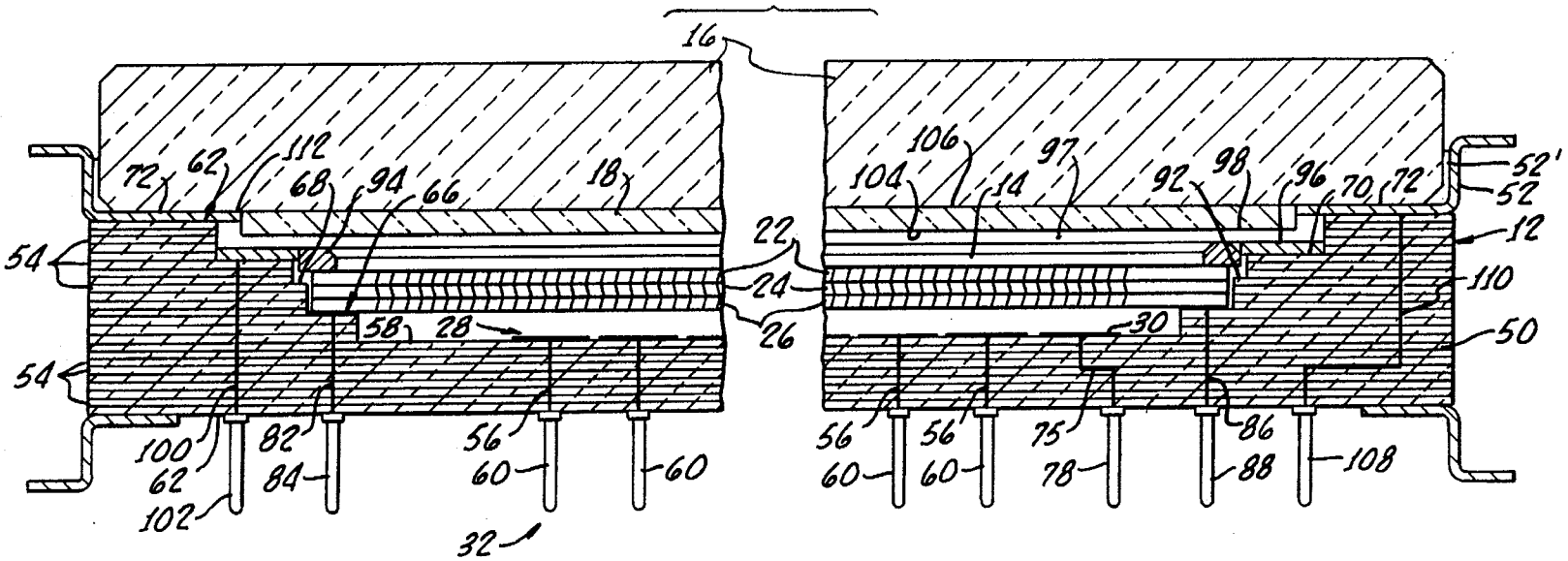
FIG. 3 is an enlarged cross sectional elevation view taken at line 3—3 of FIG. 2, and showing the component parts of the photomultiplier tube in their operative relative positions.

Still viewing FIGS. 2 and 3, it is seen that the base member 50 includes a plurality of stacked and fired ceramic layers 54. These ceramic layers are stacked and laminated with one another while the ceramic material is in its green state. Subsequently, the stacked ceramic assembly which is to become the base 50 is fired at an elevated temperature to permanently and sealingly bond the multiple ceramic layers into a unitary body. Consequently, the base member 50 is unitary, and of a single piece.

During this manufacturing operation leading to the creation of the unitary base member 50, plural conductive pathways or vias are created in and through the ceramic material of the base member 50. More particularly, multiple conductive pathways 56 are created in the stacked thin ceramic layers which connect with one another in the finished base member 50 in order to connect the multiple anodes 28 on a central planar area 58 of the base member 50 with multiple corresponding connector pins 60. These connector pins 60 secure in the base member 50 and depend from a lower surface 62 thereof. The connector pins 60 correspond with and define the array of connector pins 32 described with respect to the schematic representation of FIG. 1. The anodes 28 are separate square thin-film metallizations, and are arranged in a square array on the planar portion 58 of the base member 50. Connector pins 60 are correspondingly arrayed like the anodes 28, but are disposed on the lower surface 62 of the base member 50.

Considering the base member 50 in greater detail, it is seen that this base member includes a thickened peripheral rim portion, generally referred to with the numeral 62, and including four graduated progressively thicker and cooperating rim step portions 66–72 outwardly of the central planar area 58 which carries the anodes 28. Interposed between the anode array 28 and the first (66) of the rim step portions is a surrounding row of thin film metallized ground ring anodes 30. These ground ring anodes 30 are also generally square in plan view and are connected in common by multiple inwardly extending conductive branches 76 (seen in FIG. 5) to a depending ground connector pin 78. The ground ring anodes 30 are disposed close to but spaced slightly from the outermost ones of the anodes 28, like the ground ring 30 schematically depicted in FIG. 1. Consequently, the anodes 28 are shielded from the effects of stray electrons in the chamber 14. The ground ring anodes 30 are connected by a via 75 through the base member 50 to the depending connector pin 78. This connector pin 78 correspondingly connects to the ground lead 36 described with respect to the schematic representation of FIG. 1.

Still viewing FIGS. 2 and 3, it is seen that the innermost and lowest one 66 of the plural rim steps 66–74 defines six arcuate notches 80 which interrupt this rim step 66 and divide it into six separated circumferentially extending step parts 66*a–f*. Alternate ones of the step parts 66*a–f* are connected by a via 82 to a depending connector pin 84 (seen in FIG. 3). Similarly, the other alternate ones of the step parts 66*a–f* are connected by a via 86 to a connector pin 88 similarly depending from the surface 62 of the base member 50. That is, step parts 66*a*, 66*c*, and 66*e* are connected by the via 82 to connector pin 84, while step parts 66*b*, 66*d*, and 66*f* are connected by via 86 to the connector pin 88. It will be understood, therefore, that the vias 82 and 86 have portions (not shown) extending circumferentially in the ceramic material of housing 12.

In order to provide electrical conductivity at the step parts 66*a–f*, each is covered with a respective portion of a metallic coating, generally referenced with the numeral 90 (best seen in FIG. 4). This metallic coating is not continuous across all of the portions of step 66, but is interrupted at the notches 80 so that the step parts 66*a–f* communicate with one another only in alternate sets of three through the vias 82 and 86.

Next outwardly and above the step 66 (viewing FIG. 3), the base member 50 includes a circumferentially continuous step 68 which is very narrow, and serves to circumferentially cooperate with the step 66 to define a seat 92 for a retaining ring 94. Spaced above and outwardly of the step 68, the base member 50 includes a step 70 upon which is brazed an inwardly projecting metallic ring member 96. The ring member 96 cooperates with the step 68 to define an inwardly opening groove 98. The retaining ring 94 is removably captively received in the groove 98. This retaining ring 94 captures the three microchannel plates 22, 24, 26 in stacked and contacting relationship on the step 66.

Retaining ring 94 is also electrically contacted by the metallic ring 96. This metallic ring 96 is electrically connected with a conductive via 100 which at its upper end communicates with the step 70 and at its lower end communicates with the lower surface 62 of the base member 50 and a connector pin 102 depending therefrom. Consequently, the retaining ring 94 serves to electrically connect the connector pin 102 with an upper electrode (to be further described below) on the upper surface of the upper microchannel plate 22.

Separated from the metallic ring 96 by a vacuum gap 97, and formed on the window 16 is the photocathode 18. The window 16 is sealed into flange 52 with indium or similar seal material 52'. Flange member 52 is brazed onto the housing member 50 at step portion 72. Photocathode 18 is electrically connected through flange member 52 to connector pin 108 by way of conductive via 110. Housing 50, flange 52 and window 16 form the vacuum envelope of the device.

Considering FIGS. 2–8 in conjunction and in greater detail, it is seen that the microchannel plates 22, 24, and 26 each include a multitude of small or micro channels 114. These channels 114 are each angulated similarly with respect to the planar upper and lower surfaces of the microchannel plates 22–26. As the plates 22–26 are stacked together in the photomultiplier tube 10, these channels 114 are arranged with successively opposite angulations downwardly through the plates 22–26. Thus, in side elevation view, (seen in FIG. 7) the channels 114 define somewhat of a Z-shape. Also as seen in FIG. 7, each of the microchannel plates 22–26 includes an upper and a lower metallized electrode coatings 116, 118. FIG. 7 shows that the stacked microchannel plates 22–26 engage and electrically connect with one another at their confronting adjacent electrode coatings 116, 118.

Viewing FIGS. 2 and 8, it is seen that the lower electrode coating 118 of the lower microchannel plate 26 defines three circumferentially extending peripheral openings 120. In FIG. 2, the coating 118 is shown separated from the remainder of microchannel plate 26 for ease of illustration. However, it will be understood that this metallized coating is an not actually separable from the microchannel plate 26. At each of the peripheral openings 120 the upper electrode coating 116 includes an aligned portion 122 which extends downwardly around the outside edge 124 of the microchannel plate 26. This downwardly extending portion 122 connects with a radially inwardly and circumferentially extending portion 126 (best seen in FIG. 8).

In the base portion 50 of the housing 12, the three electrode portions 126 set on the shoulder parts 66*a*, 66*c*, and 66*e*. On the other hand, the lower electrode coating 118 of the microchannel plate 26 between the openings 120 defines three circumferentially extending portions 128. These metallized coating portions 128 set on the step parts 66*b*, 66*d*, and 66*f*. Consequently, the coating 116 is electrically connected with the connector pin 84, while the electrode coating 118 is electrically connected with the connector pin 88.

Viewing FIGS. 1 and 3, the electrical connections between the power supply 34 and the microchannel plates 22–26 is somewhat schematically depicted with the leads 38–46. These leads correspond to the connector pins 78, 88, 104, and 108. It will be noted that the preferred exemplary embodiment of the invention depicted in FIGS. 2–8 does not employ a separate electrical connection between the power supply 34 and the interface of microchannel plates 22 and 24. That is there is no physical electrical connection analogous to the lead 42 of the schematic depiction of FIG. 1. The first two microchannel plates 22 and 24 operate in electrical series, as will be explained.

However, because of the individual electrical connections to the electrode coatings of the microchannel plates 22–26, as schematically depicted, the strip current of each microchannel plate can be different and need not be the same as the strip current of any of the other plates in the cascade. This strip current of each microchannel plate is determined by the resistance of the individual plate, the voltage drop across each microchannel plate under its working condition, and the applied electrostatic voltage. While in the exemplary embodiment depicted in FIGS. 2–5, the microchannel plates 22 and 24 are electrically in series and must carry the same strip current, the microchannel plate 26 is individually supplied at its upper and lower electrode coatings 116, and 118 with electrostatic voltage from the power supply 34.

Accordingly, the microchannel plate 26 can operate as a high-output microchannel plate providing a higher signal current level than otherwise would be possible. More particularly, while a typical microchannel plate might have a strip current of 2 to 3 microamps per square centimeter ($\mu a/cm^2$), a high-output microchannel plate (such as the plate 26) can endure a strip current of about 20 $\mu a/cm^2$. Accordingly, the microchannel plate 26 can similarly provide a much higher signal current level than a conventional microchannel plate. While a cascade of conventional microchannel plates carrying a high strip current would be at risk for thermal destruction, or would be required to carry a lower strip current also limiting the signal current, the stacked microchannel plates 22–26 do not suffer from this limitation.

The first two microchannel plates 22, 24, can operate in electrical series without thermally overloading these plates or exceeding their ability to provide the necessary numbers of secondary emission electrons. On the other hand, the third microchannel plate in the cascade, the plate 26, can operate with a higher strip current than is necessary for the plates 22, and 24, while these two plates provide a heat conduction path from the high-output plate 26 to the housing 12. More particularly, the retaining ring 92, and ring 94 provide a conductive heat transfer path from the stacked microchannel plates 22–26 to the housing rim step part 70 close to the step 72 and the braze flange member 52. This braze flange member 52 provides a highly conductive heat transfer path to the environment for liberating heat from the stacked plates 22–26. This heat transfer pathway provided by the housing 12 facilitates the operation of the photomultiplier 10 with a higher level of electron multiplication than is conventionally possible.

During operation of the photomultiplier depicted in FIGS. 2–5, the photons "P", falling on the photocathode 18 free electrons "e", which fall through the cascaded microchannel plates 22–26 under the influence of the electrostatic field 48. These falling electrons cause a shower of secondary emission electrons by their interactions with the microchannel plates. As a result, the first two microchannel plates 22, and 24, operating in electrical series have the same strip current in the range of 2 to 3 microamps per square centimeter. On the other hand, the third microchannel plate 26, which enjoys individual electrical connection to the power supply 34, and which also carries the burden of supplying a much larger number of secondary electrons because it is multiplying an electron shower already multiplied by the two preceding microchannel plates, can operate at a strip, current of about 20 microamps/$cm^2$. The two preceding microchannel plates 22, 24, are relatively cool because of their relatively low strip currents and provide a heat conduction path to the housing 12 and braze flange 52 from the high-output microchannel plate 26, which generates a greater amount of heat. A resulting shower of electrons falls on the anode array 28, and is converted to signal currents at connector pins 32 which replicates the pattern of photons falling on the photocathode 18.

The photomultiplier according to the present invention is able to provide a dynamic range (i.e., the range within which the output signal currents from the anode pins 32 is linear with respect to an input photon signal) of about six orders of magnitude. That is, the present photomultiplier tube is linear in a range of from 1 unit input to about 1,000,000 unit inputs. A conventional photomultiplier tube employing a conventional MCP structure, on the other hand, is able to provide a dynamic range of only about three orders of magnitude (i.e., in a range of from 1 to 1000 input units). Thus, it is seen that the present MCP photomultiplier tube is linear in a dynamic range about 1000 times wider than the conventional MCP photomultiplier tubes. The reason for this remarkable increase in dynamic range of the present invention over the conventional technology is the ability of the third microchannel plate 26 of high-output type to supply a sufficient level of signal current.

While the present invention is depicted, described, and is defined by reference to a single preferred exemplary embodiment of the invention, such reference is not intended to imply a limitation on the invention, and no such limitation is to be inferred. The invention is subject to considerable modification and alteration, which will readily occur to those ordinarily skilled in the pertinent arts. Accordingly, the depicted and described preferred exemplary embodiment of the invention is illustrative only, and is not limiting on the invention. The invention is intended to be limited only by the spirit and scope of the appended claims, giving full cognizance to equivalents in all respects.

We claim:

1. A microchannel plate comprising:

a substrate defining opposite planar faces, a circumferentially extending edge surface, and multiple microchannels opening on said opposite faces;

a pair of electrodes correspondingly disposed on said opposite faces for receiving and distributing an applied voltage across said microchannel plate, one of said electrodes defining a peripheral circumferentially extending opening exposing said substrate, and the other of said pair of electrodes including a portion extending across said circumferential edge surface and connecting with a portion of said other electrode which is disposed in said opening, whereby one face of said microchannel plate carries said one electrode and said portion of said other electrode.

2. An MCP photomultiplier tube comprising:

a photocathode for receiving photons in a pattern and freeing electrons in response;

a stack of plural cascaded microchannel plates (MCP's) for receiving said electrons from said photocathode and successively multiplying said electrons by secondary emission of electrons to provide a shower of electrons in a pattern replicating said photons, each of said microchannel plates including a respective pair of opposite facial electrodes for receiving and distributing across the respective microchannel plate an electrostatic charge;

an anode for receiving said shower of electrons from said microchannel plates and providing a signal current in response; and electrical connection means for electrically connecting at least one of said plural microchannel plates individually to an electrical power supply, wherein said electrical connection means includes said one microchannel plate including a facial surface carrying a portion of each of said pair of electrodes for said one microchannel plate, and a housing with provision to make electrical contact with each of said electrode portions on said facial surface.

3. The MCP photomultiplier tube of claim 2 wherein said housing includes a recess having a circumferentially extending shoulder interrupted to define at least a pair of shoulder portions, each of said pair of shoulder portions carrying a respective one of a pair of conductive electrical contacts, said one microchannel plate being disposed in said housing recess and on said shoulder to electrically engage said pair of electrode portions on said facial surface individually with said pair of electrical contacts.

4. The MCP photomultiplier tube of claim 3 wherein said housing further includes a metallic ring member cooperating with said housing to define an inwardly deposed groove circumscribing said recess, a metallic retaining ring disposed in said inwardly disposed groove and electrically contacting the first of said cascaded microchannel plates in heat-transfer relation.

5. The MCP photomultiplier tube of claim 4 wherein said photocathode is disposed upon said metallic ring member.

6. The MCP photomultiplier tube of claim 5 wherein said housing further includes a metallic braze flange member circumscribing said recess and defining a heat liberating surface outwardly of said housing, said housing carrying said metallic braze flange member adjacent to said metallic ring member to complete a heat transfer path from said cascaded microchannel plates to ambient.

7. The MCP photomultiplier tube of claim 2 wherein said stacked and cascaded microchannel plates are physically in facial contact with one another to establish both electrical conductivity between adjacent microchannel plates and heat transfer relation among all of the plural microchannel plates of said photomultiplier tube.

8. An MCP photomultiplier tube including plural microchannel plates cascaded to provide an electron multiplication, said photomultiplier tube comprising:

a photocathode for receiving photons and releasing electrons in response;

an anode for receiving said electrons from said photocathode to provide a current indicative of said photon receipt;

a stack of cascaded microchannel plates disposed to receive said electrons from said photocathode and to release a proportionate shower of secondary emission electrons upon said anode;

an electrical power supply for powering said photomultiplier tube by maintaining an electrostatic potential from said photocathode across said stack of cascaded microchannel plates and to said anode;

said stack of cascaded microchannel plates including a high-output microchannel plate having a pair of opposite faces each carrying a corresponding one of a pair of conductive electrodes for said high-output microchannel plate;

said photomultiplier tube including electrical connection structure for individually connecting said pair of electrodes of said high-output microchannel plate with said electrical power supply, wherein said photomultiplier tube includes a housing which provides said individual electrical connection to said high-output microchannel plate;

wherein said housing includes a pair of shoulders each carrying one of a pair of electrical connections for said high-output microchannel plate, said high-output microchannel plate resting upon said pair of shoulders to respectively connect said pair of electrodes electrically with said pair of connections on said pair of shoulders of said housing.

9. The MCP photomultiplier tube of claim 8 wherein said high-output microchannel plate includes a facial surface carrying a portion of each of said pair of electrodes, said facial surface resting upon said pair of shoulders of said housing.

10. The MCP photomultiplier tube of claim 9 wherein said high-output microchannel plate includes a substrate defining a circumferentially extending edge surface between said pair of opposite faces and a multitude of microchannels opening at opposite ends on said pair of opposite faces of said high-output microchannel plate, one of said pair of opposite electrodes defining a circumferentially extending opening exposing said substrate, and the other of said pair of electrodes defining an aligned portion extending around said edge surface to said other face of said high-output microchannel plate and into said opening to be disposed on the same side thereof with said one electrode.

11. The MCP photomultiplier tube of claim 10 further including said stack of microchannel plates and said housing including structural feature means for cooperatively defining a conductive heat transfer path from said high-output microchannel plate to ambient.

12. The MCP photomultiplier tube of claim 11 wherein said structural feature means includes said housing carrying a retaining ring in heat transfer relation with said stack of microchannel plates, said high-output microchannel plate being in heat transfer relation with the remainder of said stack of microchannel plates, and said housing including an outwardly disposed heat-liberating feature conducting heat to ambient and being in heat transfer relation with said retaining ring.

13. The MCP photomultiplier tube of claim 8 wherein said housing includes a non-conductive disk-like body defining a shallow recess, a plurality of circumferentially extending peripheral rim step portions circumscribing said recess and defining an opening thereto, said anode being disposed at a bottom of said recess, said stack of microchannel plates being disposed on one of said plural rim step portions above said anode, said photocathode being disposed on another of said rim step portions above said stack of microchannel plates, and a window member sealingly cooperating with said disk-like body to span an close said opening to define an evacuated chamber receiving said photocathode, said stack of microchannel plates, and said anode.

14. The MCP photomultiplier tube of claim 13 wherein said housing carries individual metallized contacts on said peripheral rim step portions which electrically connect individually and correspondingly with said photocathode, with said stack of microchannel plates, with said high-output microchannel plate, and with respective electrical connector features outwardly exposed on said housing.

15. A method of making a microchannel plate, said method including the steps of:

providing a perforate substrate having a pair of opposite faces and defining plural microchannels therethrough;

forming a first electrically conductive electrode on one of said opposite faces;

forming a second electrically conductive electrode on the other of said opposite faces; and wrapping a portion of said second electrode around an edge of said substrate to reside on said one opposite face.

16. The method of claim 15 further including the steps of forming said first electrode with an opening, and disposing said portion of said second electrode within said opening of said first electrode.

17. A method of making a photomultiplier tube having a high-output microchannel plate, said method comprising the steps of:

stacking said high-output microchannel plate in heat-transfer relation with an adjacent comparatively lower output microchannel plate;

associating said adjacent lower-output microchannel plate in heat-transfer relation with a housing of said photomultiplier tube; and employing said lower-output microchannel plate as a heat-conduction member to transfer electrical resistive heat from said high-output microchannel plate to said housing.

18. The method of claim 17 further including the step of providing a heat-liberating feature externally on said housing, and employing said heat-liberating feature to liberate heat from said high-output microchannel plate to ambient.

19. A method of making a photomultiplier tube having a unitary ceramic body, said method comprising the steps of:

forming said unitary ceramic body in a disk-like form with a pair of opposite faces, one face of which defines a shallow recess with a central planar surface and at least a pair of step-like shoulders extending circumferentially of said central planar surface, the outer one of said step-like shoulders being circumferentially continuous;

disposing an anode on said central planar surface;

disposing a microchannel plate on one of said step-like shoulders spaced from said anode;

sealingly associating a window member with said body at said outer circumferentially continuous step-like shoulder to define a vacuum chamber within said recess; and carrying a photocathode upon said window member within said vacuum chamber.

20. The method of claim 19 further including the steps of circumferentially interrupting said one step-like shoulder to define step-like shoulder portions extending circumferentially of said recess;

providing electrical contacts on respective ones of said shoulder portions; and employing said electrical contacts to connect said microchannel plate to a high-voltage power supply.

21. The method of claim 20 additionally including the steps of stacking plural microchannel plates on said shoulder portions.

22. The method of claim 21 further including the steps of forming one of said microchannel plates with a pair of electrodes, a portion of each of which is peripherally disposed on one face thereof;

disposing said one microchannel plate at said one face on said shoulder portions; and employing one of said pair of electrodes of said one microchannel plate to electrically connect a next-adjacent microchannel plate of said plural microchannel plates with said high-voltage power supply.

23. The method of claim 21 additionally including the steps of including in said stack of plural microchannel plates a high-output microchannel plate which is subject to electrical resistance heating beyond the thermal endurance of said high-output microchannel plate, associating the other microchannel plates of said plural microchannel plates in heat-transfer relationship with both said high-output microchannel plate and with said housing; and employing said other microchannel plates to conduct heat from said high-output microchannel plate; whereby said high-output microchannel plate is able to endure said electrical resistance heating.

24. The method of claim 23 further including the steps of associating with said unitary ceramics body a metallic flange member interposing between said ceramic body and said window member;

providing an outwardly-disposed heat-liberating feature on said flange member; and disposing said flange member in heat-transfer relation with said other microchannel plates of said stacked plurality of microchannel plates.

* * * * *